US011142448B2

(12) United States Patent
McKay et al.

(10) Patent No.: US 11,142,448 B2
(45) Date of Patent: Oct. 12, 2021

(54) SYSTEM AND METHOD FOR DISTRIBUTING FUEL

(71) Applicant: 1119456 B.C. LTD., Kelowna (CA)

(72) Inventors: Stephen William McKay, Kelowna (CA); Neil Joseph Ladd, Kelowna (CA)

( * ) Notice: Subject to any disclaimer, the term of this patent is extended or adjusted under 35 U.S.C. 154(b) by 0 days.

(21) Appl. No.: 16/693,104

(22) Filed: Nov. 22, 2019

(65) Prior Publication Data

US 2021/0155467 A1 May 27, 2021

(51) Int. Cl.
*B67D 7/36* (2010.01)
*B67D 7/04* (2010.01)

(52) U.S. Cl.
CPC ..... *B67D 7/0401* (2013.01); *B67D 7/362* (2013.01)

(58) Field of Classification Search
CPC ..... B67D 7/0401; B67D 7/362
See application file for complete search history.

(56) References Cited

U.S. PATENT DOCUMENTS

2011/0197988 A1* 8/2011 Van Vliet ..... B67D 7/362 141/1
2017/0101305 A1* 4/2017 McKay ..... B67D 7/04
2018/0099858 A1* 4/2018 Shock ..... B67D 7/3218

* cited by examiner

*Primary Examiner* — Jason K Niesz
(74) *Attorney, Agent, or Firm* — Richard D. Okimaw

(57) ABSTRACT

A system and method for delivering fuel to a plurality of vehicles comprising a distribution manifold having a plurality of outlets, said distribution manifold in fluidic communication with a fuel source, each of said plurality of outlets having an associated control valve for controlling fluid flow therethrough and a plurality of tank valve assemblies in fluidic communication with one of said plurality of fuel lines each located at an inlet to a tank of one of said plurality of vehicles, each of said tank valve assembly being operable to shut off flow of fuel therethrough when said tank is filled to a predetermined level. The system further comprises a plurality of fuel lines, each of said plurality of fuel lines extending between an outlet of said distribution manifold and a tank valve assembly and a controller operably coupled to said plurality of control valves wherein said adapted to sequentially open at least one of said plurality of control valves at a time.

20 Claims, 5 Drawing Sheets

SYSTEM AND METHOD FOR DISTRIBUTING FUEL

BACKGROUND OF THE INVENTION

1. Field of Invention

The present invention relates generally to refueling systems and in particular to a system and method for distributing fuel to a plurality of continuously running vehicles.

2. Description of Related Art

Many industrial processes require the use of multiple vehicles to be operated continuously at a worksite. One example of such environments is at a hydraulic fracturing or fracking site. In such locations, multiple pump trucks are required to provide the fracking site with sufficient fracking fluid. Such trucks are disadvantageously required to be operated continuously during such fracking operations and therefore will also be required to be refueled during operation.

One common difficulty with such fracking operations is the need to refuel the multiple trucks to ensure continued operation. One common method of refueling such trucks is to provide a fuel tank and personnel to monitor and refill the tank on each truck as needed. It will be appreciated that such methods are time consuming and prone to error if sufficient personnel are not present. Additionally, the fuel lines required for filling each truck may pose a safety hazard when distributed around the worksite.

Other methods have attempted to provide a system of automatically distributing fuel to such trucks by providing sensors in each truck with a valve and manifold assembly at the common source tank. Such systems, disadvantageously however require the use of electrical sensors which may pose spark risk at the work site and also disadvantageously depressurize each of the fuel lines to each truck reducing the responsiveness of supply each truck. Examples of such systems may be found in US Patent Application Publication No. 2011/0197988 to Van Vliet et al.

SUMMARY OF THE INVENTION

According to a first embodiment of the present invention there is disclosed a system for delivering fuel to a plurality of vehicles comprising a distribution manifold having a plurality of outlets, said distribution manifold in fluidic communication with a fuel source, each of said plurality of outlets having an associated control valve for controlling fluid flow therethrough and a plurality of tank valve assemblies in fluidic communication with one of said plurality of fuel lines each located at an inlet to a tank of one of said plurality of vehicles, each of said tank valve assembly being operable to shut off flow of fuel therethrough when said tank is filled to a predetermined level. The system further comprises a plurality of fuel lines, each of said plurality of fuel lines extending between an outlet of said distribution manifold and a tank valve assembly and a controller operably coupled to said plurality of control valves wherein said adapted to sequentially open at least one of said plurality of control valves at a time.

The system may further comprise a pressure sensor on said distribution manifold. The controller may be adapted to receive a pressure measurement from said pressure sensor wherein said controller is further configured to close said at least one of said plurality of control valves and open a different control valve when said pressure measurement is greater predetermined amount indicating said tank valve is closed.

The controller may be operable to open a single control valve at a time. The controller may be operable to open two or more of said plurality of control valves at a time. The system may further comprise a temperature sensor adapted to measure a temperature of said fuel flowing through said manifold.

The system may further comprise a pump operable to draw fuel from said fuel source and provide said fuel to said distribution manifold. The pump may include a flow mater adapted to output a signal to said controller representing rate of flow of said fluid through said pump. The control circuit may be adapted to disable a control valve and provide an alert when said pressure sensor detects a pressure drop greater than a predetermined level. Each of said valve assemblies may comprise a mechanical valve.

According to a further embodiment of the present invention there is disclosed a method for delivering fuel to a plurality of vehicles comprising providing a distribution manifold in fluidic communication with a fuel source and having a plurality of outlets, each of said plurality of outlets having an associated control valve for controlling fluid flow therethrough and locating a tank valve assembly at an inlet to a tank of one of said plurality of vehicles, each of said valve assembly being operable to independently shut off flow of fuel therethrough when said tank is filled to a predetermined level. The method may further comprise connecting a plurality of fuel lines between an outlet of said distribution manifold and a tank valve assembly and utilizing a controller, sequentially opening at least one of said plurality of control valves at a time.

The method may further comprise a measuring a pressure within said distribution manifold with a pressure sensor. The controller may be adapted to receive a pressure measurement from said pressure sensor wherein said controller is further configured to close said at least one of said plurality of control valves and open a different control valve when said pressure measurement is greater predetermined amount indicating said tank valve is closed.

The controller may be operable to open a single control valve at a time. The controller may be operable to open two or more of said plurality of control valves at a time. The method may further comprise measuring the temperature of said fuel through said distribution manifold with a temperature sensor.

The method may further comprise pumping with a pump fuel from said fuel source and providing said fuel to said distribution manifold. The pump may include a flow mater adapted to output a signal to said controller representing rate of flow of said fluid through said pump. The control circuit may be adapted to disable a control valve and provide an alert when said pressure sensor detects a pressure drop greater than a predetermined level. Each of said valve assemblies may comprise a mechanical valve.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
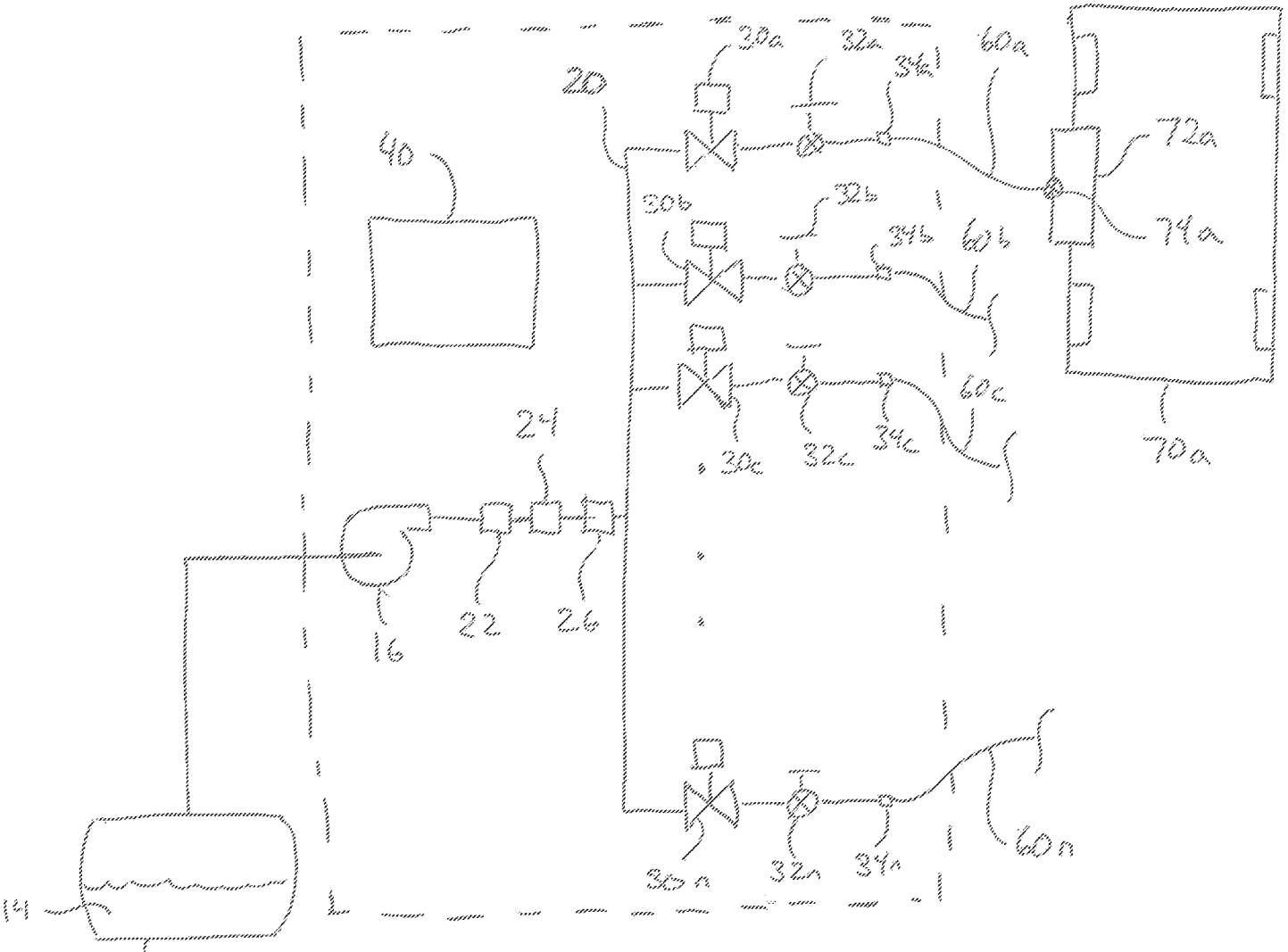
FIG. 1 is a schematic view of a fuel delivery system according to a first embodiment of the present invention.
Figure 2:
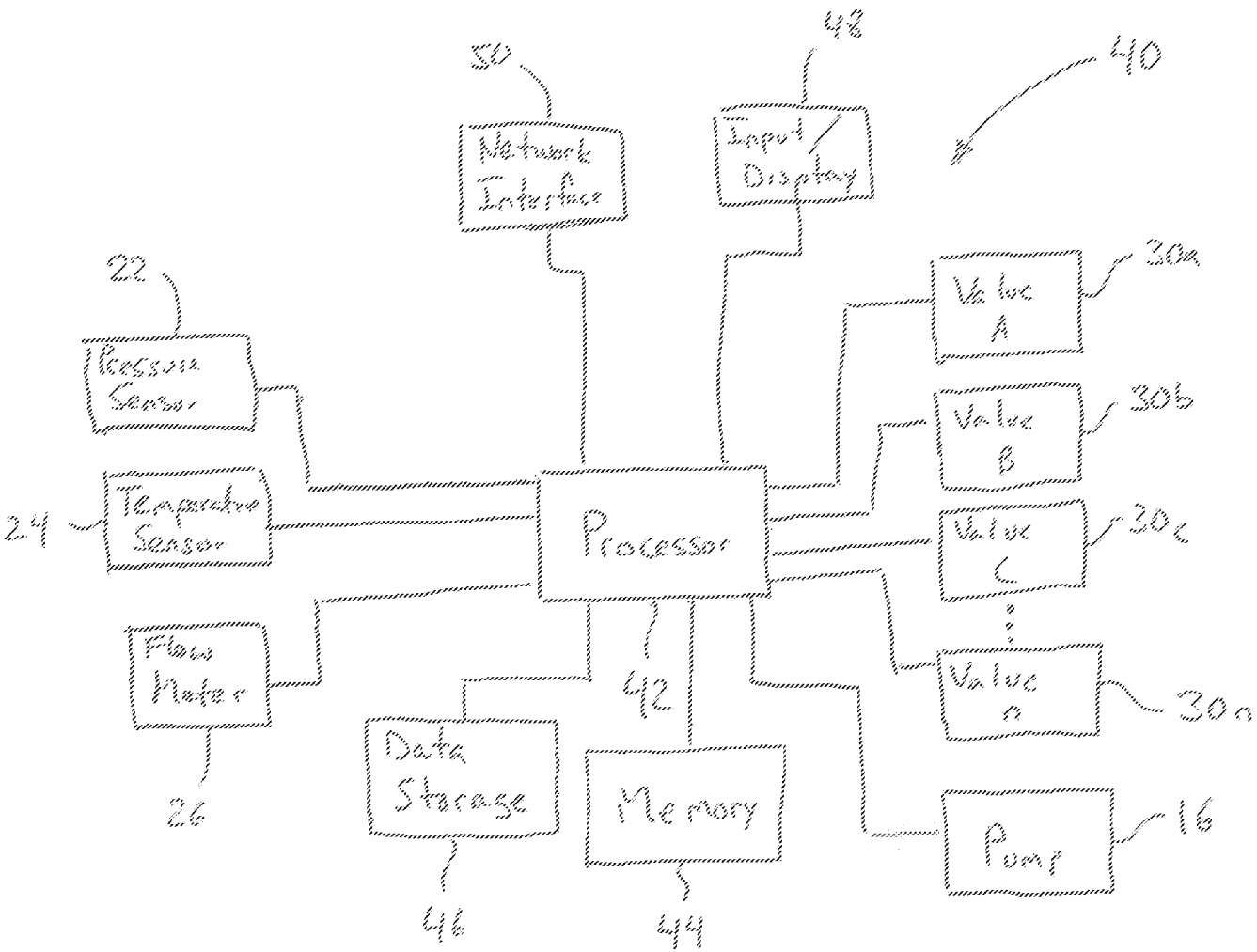
FIG. 2 is a schematic illustration of a controller for use in the system of FIG. 1.
Figure 3:
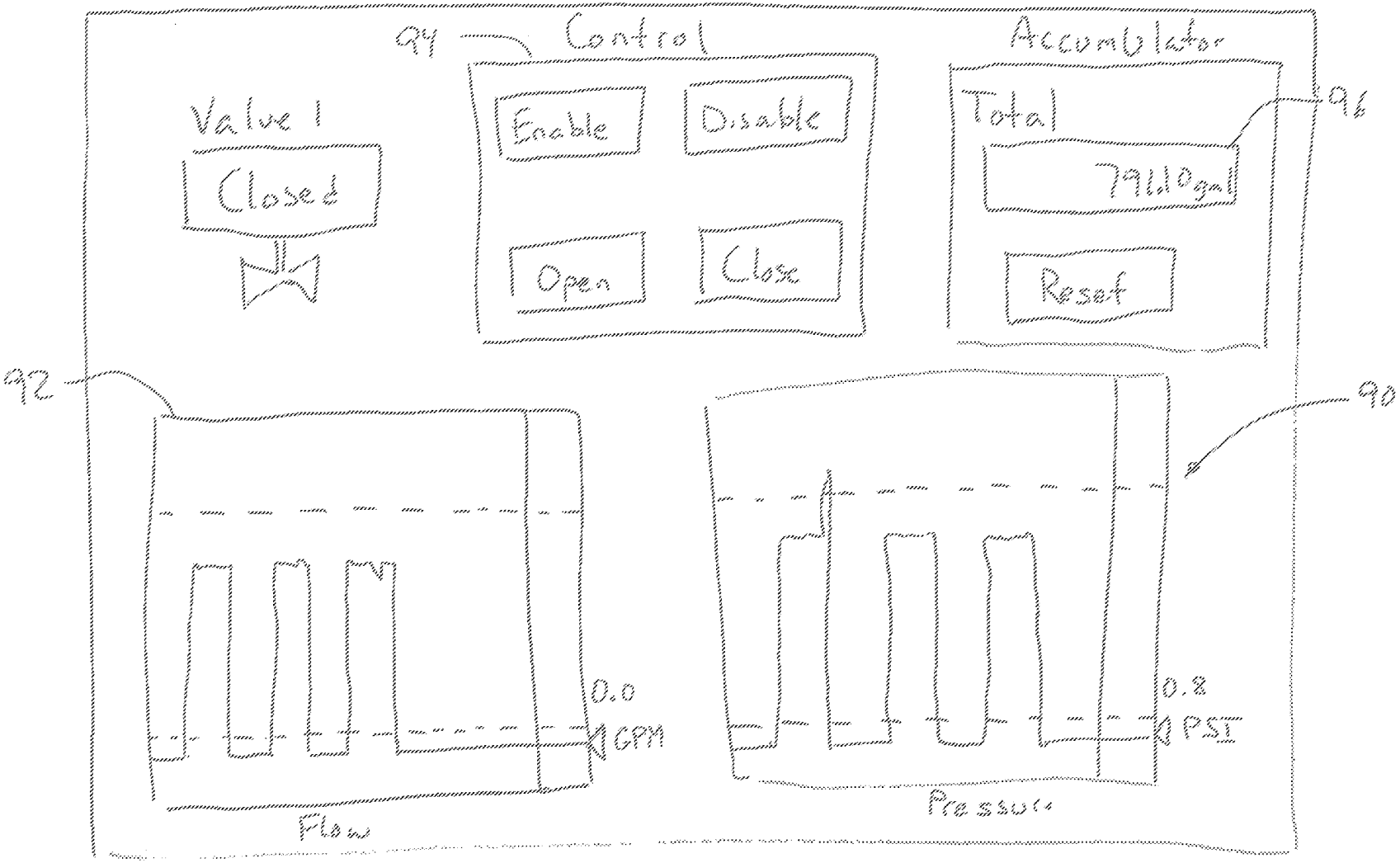
FIG. 3 is a graphical representation of a flow rate and pressure through to a single control valve to a single vehicle in the system of FIG. 1.

Referring to FIG. 1, a system for refuelling a plurality of continuously operating vehicles according to a first embodiment of the invention is shown generally at 10. The system draws fuel from a fuel tank 12 containing a quantity of a fuel source 14 and includes a pump 16 operable to draw the fuel source out of the tank and a distribution manifold 20 to distribute the pumped fuel to a plurality of fuel supply lines 60*a*, 60*b*, 60*c* through 60*n* to a plurality of vehicles 70*a*, 70*b*, 70*c* through 70*n* wherein n denotes the total quantity of trucks to be supplied with fuel. For the sake of clarity of FIG. 1, only a single vehicle 70*a* is illustrated.

As further illustrated in FIG. 1, each branch of the distribution manifold 20 includes a control valve 30*a*, 30*b*, 30*c* through 30*n* and shut off valves 32*a*, 32*b*, 32*c* through 32*n* as are commonly known and terminates at a connector 34*a*, 34*b*, 34*c* through 34*n*. Each connector 34*a* through 34*n* may be utilized to connect a fuel supply line 60*a*, 60*b*, 60*c* through 60*n* which extends to a tank valve 74*a*, 74*b*, 74*c* through 74*n* in the tank 72*a*, 72*b*, 72*c* through 72*n* each vehicle 70*a* through 70*n*.

Each tank valve 74*a* through 74*n* is adapted to shut off flow of fuel into the vehicle mounted tank 72*a* through 72*n* when the fuel level in that tank is at a predetermined level. It will be appreciated that any valve types may be utilized in which the flow of fuel through the valve is adapted to be stopped when the tank 72*a* through 72*n* is determined to be full without any intervention or involvement from the controller such as, by way of non-limiting example, mechanical, electromechanical or electrically, pneumatic or hydraulically controlled. In particular, automatically closing valves such as set out in U.S. Pat. Nos. 6,311,723 and 9,725,295, may be utilized the entirety of each of which is hereby incorporated by reference.

Optionally, the system may include a pressure sensor 22 adapted to measure the pressure within the distribution manifold 20 as well as a temperature sensor 24 adapted to measure the temperature of the manifold 20 or the fuel flowing therethrough. A flow meter 26 may also be incorporated into the manifold to measure the flow rate of fuel therethrough. It will be appreciated that the flow meter 26 may be separate from or incorporated into the pump 16.

The control module 40 includes a processor 42 operable to start and stop the pump 16 and open and close the control valves 30*a* through 30*n* according to predetermined parameters. In particular, the control module 40 is adapted to cause the pump 16 to run and open the control valves 30*a* through 30*n* in sequence for an amount of time sufficient to fill the each of the vehicle mounted tanks 32 to a predetermined level and also to close each of the control valves when the associated tank valve 72*a* through 72*n* closes as will be more fully described below. In such manner, the vehicle mounted tanks 32 will be filled sequentially either in singles or multiples thereby reducing required size and flow rate of the pump as well as reducing down time of the pump while flow is switched to successive tanks.

More generally, in this specification, the term "processor" is intended to broadly encompass any type of device or combination of devices capable of performing the functions described herein, including (without limitation) other types of microprocessors, microcontrollers, other integrated circuits, either alone or in combination with other such devices located at the same location or remotely from each other across a network or the like. Additional types of processors will be apparent to those of ordinarily skilled in the art upon review of this specification, and substitution of any such other types of processor is considered not to depart from the scope of the present invention as defined by the claims appended hereto. In various embodiments, the processor 42 can be implemented as a single-chip, multiple chips and/or other electrical components including one or more integrated circuits and printed circuit boards. The processor 42 together with a suitable operating system may operate to execute instructions in the form of computer code and produce and use data. By way of example and not by way of limitation, the operating system may be Windows-based, Mac-based, or Unix or Linux-based, among other suitable operating systems. Operating systems are generally well known and will not be described in further detail here.

Computer code comprising instructions for the processor 42 to carry out the various embodiments, aspects, features, etc. of the present disclosure may reside in the memory 44. Memory 44 encompasses one or more storage mediums and generally provides a place to store computer code (e.g., software and/or firmware) and data that are used by the processor 42. The memory 44 may comprise, for example, electronic, optical, magnetic, or any other storage or transmission device capable of providing the processor 42 with program instructions. Memory 44 may further include a floppy disk, CD-ROM, DVD, magnetic disk, memory chip, ASIC, FPGA, EEPROM, EPROM, flash memory, optical media, or any other suitable memory from which processor 42 can read instructions in computer programming languages. Memory 44 may include various other tangible, non-transitory computer-readable media including Read-Only Memory (ROM) and/or Random-Access Memory (RAM).

The control module 40 further includes a data storage 46 of any conventional type operable to store data representing operation of the various components of the system 10 as set out below for retrieval and analyses by a user. The data storage may be of any conventional type including magnetic disk, memory chips, flash memory or any other suitable computer readable memory type from which the processor can store and access data therefrom.

Processor 42 is generally coupled to at least one of variety of interfaces such as graphics interface such as, by way of non-limiting example, an input and display unit 48 as are commonly known. The input control 34 and user input interface 36. The input and display unit 48 may receive user input commands via touchscreen, a physical keyboard, virtual keyboard, etc. and display current status or other analytical information on a screen, led or other output device as are commonly known. Processor 42 may also be coupled to a network interface 50 that allows the processor to be coupled to another computer or telecommunications network (e.g., internet). More particularly, the network interface generally allows processor 42 to receive information from and to output information to the network in the course of performing various method steps described in the embodiments herein. It will be appreciated that the input and display unit 48 may be integrated into the control module 40 or ay optionally be remote therefrom and in communication through a wireless, wired or other communication medium as are commonly known.

In operation, a user may program and activate the sequence of operation for the pump 16 and control valves 30*a* though 30*n* after connection of the system 10 to a plurality of vehicles 70*a* through 70*n* as well as a fuel tank 12. In particular, the user may enter variables to the system including the number of vehicles, type of fuel as well as identification or particulars of the vehicles for later analysis of vehicle performance. The processor 42, once initiated by the users, thereafter activates the pump and opens one or more control valves 30*a* through 30*n*. to begin fuel flow to these vehicles. Thereafter the processor will continue to control the operation of the pump 16 and control valves 30*a* through 30*n* to sequentially deliver fuel to the vehicles. It will be appreciated that such sequential operation will optionally deliver fuel to a single vehicle at a time although the processor may also be configured to deliver fuel to a multiple (eg. 2 or more of the total number) at a time as permitted depending upon the sizing of the pump 16 and needs of the vehicles. The processor 42 through the pressure sensor 22 and flow meter 26 may be operable to track and record the continuous pressure 90 and flow rate 92 when each control valve is open for display to an operator for future analysis. The input and display unit 48 may also indicate the current status for that particular valve 94 and a total fuel delivered 96 to that tank valve. It will be appreciated that such total fuel delivered to each vehicle may be useful for troubleshooting individual vehicles or balancing the overall system. It will be appreciated that the display may be configured or customized to be operable to show such details and or information for one or a plurality of control valves as is commonly known.

Figure 4:
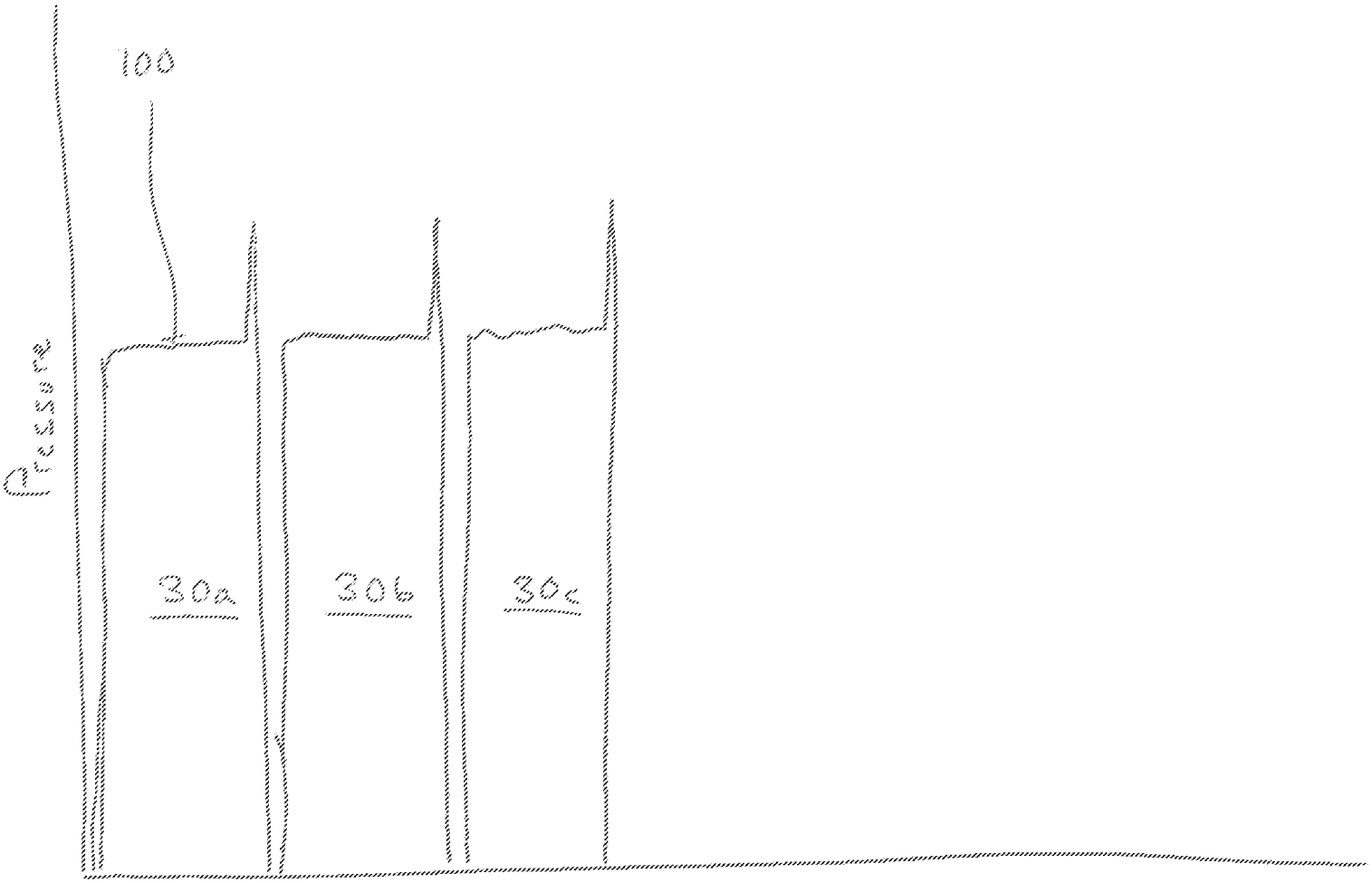
FIG. 4 is a graphical representation of the pressure as measured within the manifold during operation of the system of FIG. 1.

Turning now to FIG. 4, during operation, the processor 42 monitors the pressure 100 in the manifold 20 as outputted by the pressure sensor 22. For illustrative purposes, which is not intended to be limiting, the in the example shown in FIG. 4, the processor 42 has been programmed to sequentially open a single control valve at a time starting at 74*a* and continuing through to 74*n* whereupon the sequence may begin again at 74*a*. In particular, as illustrated, initially control valve 30*a* is opened until a pressure spike is detected upon which control valve 30*a* is closed and the next valve 30*b* is opened. Valve 30*b* is also then kept open until full at which the processor switches the fuel to valve 30*c*. This process is repeated until the sequence is completed at which time it may be repeated. The pressure sensor 22 may also be utilized to measure a reduction in pressure when a particular control valve 30*a* through 30*n* is opened to indicate a leak or disconnection of the fuel line 60*a* through 60*n*. The processor may thereafter be programmed to indicate an alert or fault to a user or may also optionally be programmed to turn off that particular control valve and disable it during subsequent sequences until the fault or error is indicated by a user to be corrected.

The processor may also utilize an output signal produced by the temperature sensor 24 to determine the temperature of the fuel being delivered to each vehicle. It will be appreciated that the actual quantity of fuel being delivered to each vehicle may therefore be volume corrected from this temperature measurement. It will furthermore be appreciated that the temperature measurement may also be utilized to adjust the pressure tables utilized as set out above to determine when a vehicle tank is full due to the changes in the viscosity of the fuel at that temperature.

Figure 5:
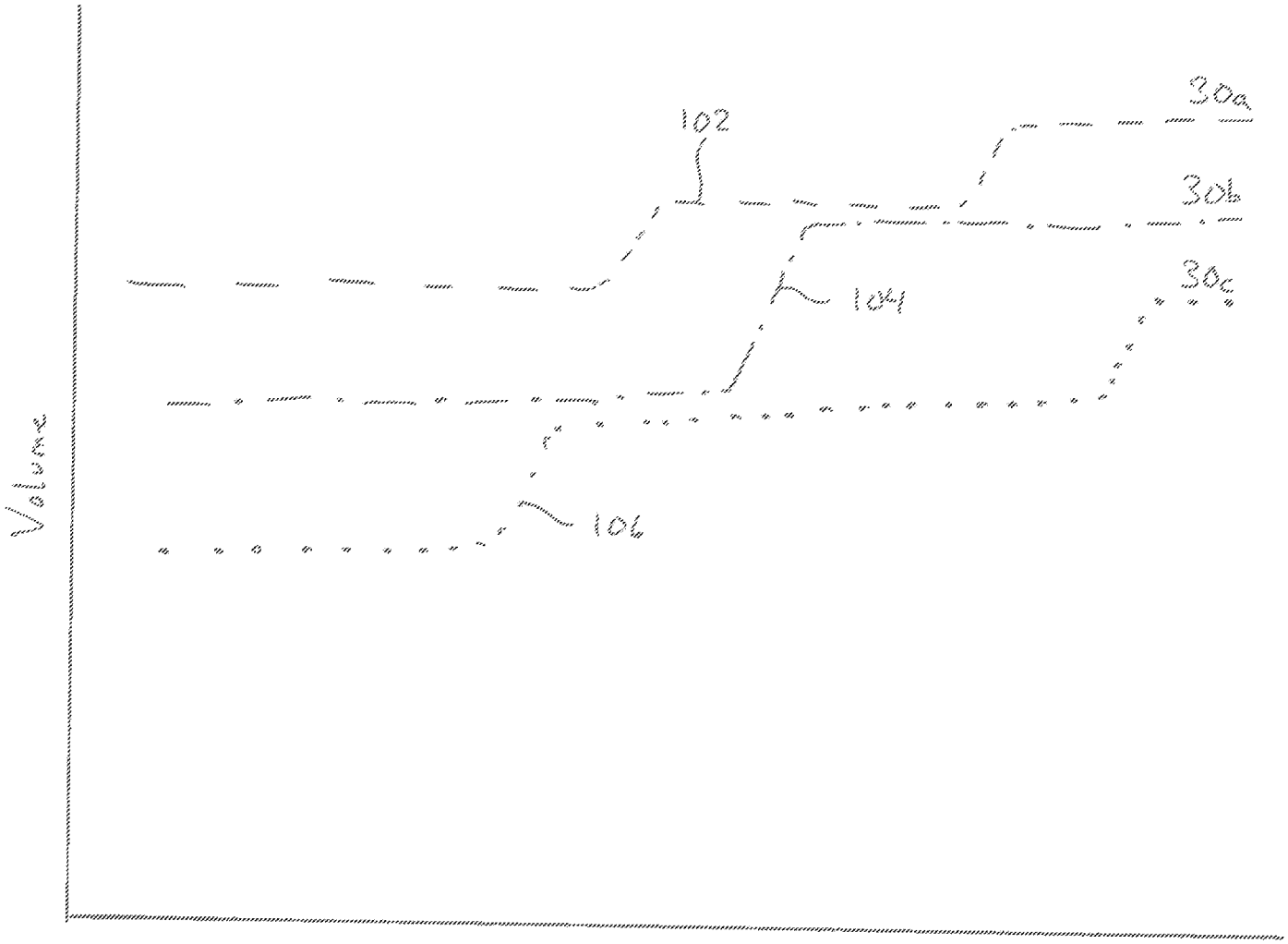
FIG. 5 is a graphical representation of the flow delivered to each tank valve during operation of the system of FIG. 1.

With reference to FIG. 5, the processor 42 may store within the data storage 46 record of any information concerning the operation of the system 10 as desired by a user. In particular, the total volume of fuel supplied to by each control valve 30*a* through 30*n* (and thereby the volume supplied to each vehicle) may be stored. This and provided in as illustrated in FIG. 5, this total volume may be outputted and/or displayed to a user in graphical form 110 wherein the volume supplied through each of the control valves 30*a*, 30*b* and 30*c* is illustrated as 102, 104 and 106, respectively. it will be appreciated that such information may be utilized for assessing performance and operation of the overall location.

While specific embodiments of the invention have been described and illustrated, such embodiments should be considered illustrative of the invention only and not as limiting the invention as construed in accordance with the accompanying claims.

What is claimed is:

1. A system for delivering fuel to a plurality of vehicles comprising:

a distribution manifold having a plurality of outlets, said distribution manifold in fluidic communication with a fuel source, each of said plurality of outlets having an associated control valve for controlling fluid flow therethrough;

a plurality of fuel lines, each of said plurality of fuel lines extending between an outlet of said distribution manifold and a vehicle;

a plurality of tank valve assemblies in fluidic communication with one of said plurality of fuel lines each located at an inlet to a tank of one of said plurality of vehicles, each of said tank valve assembly being operable to shut off flow of fuel therethrough when said tank is filled to a predetermined level; and a controller operably coupled to said plurality of control valves wherein said controller is adapted to sequentially open at least one of said plurality of control valves at a time so as to supply fuel to the tanks in the plurality of vehicles in subsets less than the total number of vehicles at a time, after which fuel is supplied to a subsequent subset of the total number of vehicles.

2. The system of claim 1 wherein said controller is operable to open a single control valve at a time.

3. The system of claim 1 wherein said controller is operable to open two or more of said plurality of control valves at a time.

4. The system of claim 1 further comprising a temperature sensor adapted to measure a temperature of said fuel flowing through said manifold.

5. The system of claim 1 wherein said each of said valve assemblies comprise a mechanical valve.

6. The system of claim 1 further comprising a pressure sensor on said distribution manifold.

7. The system of claim 6 wherein said controller is adapted to receive a pressure measurement from said pressure sensor wherein said controller is further configured to close said at least one of said plurality of control valves and open a different control valve when said pressure measurement is greater by a predetermined amount indicating said tank valve is closed.

8. The system of claim 6 further comprising a pump operable to draw fuel from said fuel source and provide said fuel to said distribution manifold.

9. The system of claim 8 wherein said pump includes a flow meter adapted to output a signal to said controller representing rate of flow of said fluid through said pump.

10. The system of claim 8 wherein said control circuit is adapted to disable a control valve and provide an alert when said pressure sensor detects a pressure drop greater than a predetermined level.

11. A method for delivering fuel to a plurality of vehicles comprising:

providing a distribution manifold in fluidic communication with a fuel source and having a plurality of outlets, each of said plurality of outlets having an associated control valve for controlling fluid flow therethrough;

locating a tank valve assembly at an inlet to a tank of one of said plurality of vehicles, each of said valve assembly being operable to independently shut off flow of fuel therethrough when said tank is filled to a predetermined level;

connecting a plurality of fuel lines between an outlet of said distribution manifold and a tank valve assembly; and utilizing a controller, sequentially opening at least one of said plurality of control valves at a time so as to supply fuel to the tanks in the plurality of vehicles in subsets less than the total number of vehicles at a time, after which fuel is supplied to a subsequent subset of the total number of vehicles.

12. The method of claim 11 wherein said controller is operable to open a single control valve at a time.

13. The method of claim 11 wherein said controller is operable to open two or more of said plurality of control valves at a time.

14. The method of claim 11 further comprising measuring the temperature of said fuel through said distribution manifold with a temperature sensor.

15. The method of claim 11 wherein said each of said valve assemblies comprise a mechanical valve.

16. The method of claim 11 further comprising a measuring a pressure within said distribution manifold with a pressure sensor.

17. The method of claim 16 wherein said controller is adapted to receive a pressure measurement from said pressure sensor wherein said controller is further configured to close said at least one of said plurality of control valves and open a different control valve when said pressure measurement is greater by a predetermined amount indicating said tank valve is closed.

18. The method of claim 16 further comprising pumping with a pump fuel from said fuel source and providing said fuel to said distribution manifold.

19. The method of claim 18 wherein said pump includes a flow meter adapted to output a signal to said controller representing rate of flow of said fluid through said pump.

20. The method of claim 18 wherein said control circuit is adapted to disable a control valve and provide an alert when said pressure sensor detects a pressure drop greater than a predetermined level.

* * * * *